US008163664B2

(12) United States Patent
Weller, Jr.

(10) Patent No.: US 8,163,664 B2
(45) Date of Patent: Apr. 24, 2012

(54) FIBERGLASS PRODUCTS FOR REDUCING THE FLAMMABILITY OF MATTRESSES

(75) Inventor: David E Weller, Jr., Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1542 days.

(21) Appl. No.: 11/187,741

(22) Filed: Jul. 22, 2005

(65) Prior Publication Data

US 2006/0021148 A1 Feb. 2, 2006

Related U.S. Application Data

(60) Provisional application No. 60/592,990, filed on Jul. 30, 2004.

(51) Int. Cl.
*B32B 27/04* (2006.01)
*B32B 17/02* (2006.01)

(52) U.S. Cl. ..... 442/136; 442/180; 428/920; 428/921

(58) Field of Classification Search ..... 442/136, 442/180, 394, 401
See application file for complete search history.

(56) References Cited

U.S. PATENT DOCUMENTS

| | | | |
|---|---|---|---|
| 3,670,348 | A | 6/1972 | Irwin |
| 3,818,521 | A | 6/1974 | Richards |
| 4,088,620 | A | 5/1978 | Nihongi et al. |
| 4,092,752 | A | 6/1978 | Dougan |
| 4,198,494 | A | 4/1980 | Burckel |
| 4,282,283 | A | 8/1981 | George et al. |
| 4,430,765 | A | 2/1984 | Karpen |
| 4,443,903 | A | 4/1984 | Leitner |
| 4,504,991 | A | 3/1985 | Klancnik |
| 4,526,830 | A | 7/1985 | Ferziger et al. |
| 4,690,859 | A | 9/1987 | Porter et al. |
| 4,726,987 | A | 2/1988 | Trask et al. |
| 4,801,493 | A | 1/1989 | Ferziger et al. |

(Continued)

FOREIGN PATENT DOCUMENTS

| | | |
|---|---|---|
| DE | 2364091 | 7/1974 |

(Continued)

OTHER PUBLICATIONS

International Search Report and Written Opinion from PCT/US05/26255 dated Dec. 12, 2005.

(Continued)

*Primary Examiner* — Lynda Salvatore
(74) *Attorney, Agent, or Firm* — Calfee, Halter & Griswold LLP

(57) ABSTRACT

Glass fiber products used to reduce the flammability of mattresses and upholstery are provided. In one embodiment, a veil formed of glass fibers, comfort enhancing fibers, and optionally a combination of synthetic fibers is positioned on the bottom of a mattress to provide fire resistance or prevention. The binder composition used to form the veil may include a binder with a low glass transition temperature and a flame retardant additive. In a second embodiment, a glass veil is utilized in a fire retarding composite formed of an encapsulating layer, a fire retarding veil, and a backing layer. Preferably, all of the fibers in the veil are glass fibers. The fire retarding composite is positioned on the mattress with the encapsulating layer against the cushioning material, the backing layer facing externally, and the veil sandwiched between the encapsulating layer and the backing layer. A fire retarding insulation product is also provided.

5 Claims, 8 Drawing Sheets

U.S. PATENT DOCUMENTS

| | | | | |
|---|---|---|---|---|
| 4,806,185 | A | 2/1989 | Porter et al. | |
| 4,863,797 | A | 9/1989 | Ichibori et al. | |
| 4,865,906 | A | 9/1989 | Smith, Jr. | |
| 4,923,729 | A | 5/1990 | Porter et al. | |
| 4,927,698 | A | 5/1990 | Jaco et al. | |
| 4,941,884 | A | 7/1990 | Green | |
| 4,950,540 | A | 8/1990 | McCullough, Jr. et al. | |
| 4,970,111 | A | 11/1990 | Smith, Jr. | |
| 4,987,026 | A | 1/1991 | Jacobs et al. | |
| 4,996,289 | A | 2/1991 | Berbner et al. | |
| 5,084,488 | A | 1/1992 | Weiser et al. | |
| 5,149,582 | A | 9/1992 | LaMarca, II et al. | |
| 5,162,487 | A | 11/1992 | Weiser et al. | |
| 5,169,582 | A | 12/1992 | Illing | |
| 5,208,105 | A | 5/1993 | Ichibori et al. | |
| 5,308,692 | A | 5/1994 | Kennedy et al. | |
| 5,348,796 | A | 9/1994 | Ichibori et al. | |
| 5,399,422 | A | 3/1995 | Dijkema et al. | |
| 5,484,653 | A | 1/1996 | Kennedy et al. | |
| 5,496,625 | A | 3/1996 | Lilani | |
| 5,503,915 | A | 4/1996 | Ichibori et al. | |
| 5,503,916 | A | 4/1996 | Ichibori et al. | |
| 5,506,042 | A | 4/1996 | Ichibori et al. | |
| 5,534,325 | A | 7/1996 | Joerder et al. | |
| 5,540,980 | A | 7/1996 | Tolbert et al. | |
| 5,560,990 | A | 10/1996 | Ilg et al. | |
| 5,585,161 | A | 12/1996 | Difloe et al. | |
| 5,645,926 | A | 7/1997 | Horrocks et al. | |
| 5,694,981 | A | 12/1997 | Stanhope et al. | |
| 5,723,216 | A | 3/1998 | Houpt et al. | |
| 5,766,681 | A | 6/1998 | Stoddart et al. | |
| 5,824,614 | A | 10/1998 | Gadoury | |
| 5,840,413 | A | 11/1998 | Kajander | |
| 5,849,648 | A | 12/1998 | Kent et al. | |
| 5,853,880 | A | 12/1998 | Kent et al. | |
| 5,888,652 | A | 3/1999 | Berbner et al. | |
| 5,918,453 | A | 7/1999 | Kent et al. | |
| 5,935,882 | A | 8/1999 | Fujita et al. | |
| 5,968,855 | A | 10/1999 | Perdelwitz, Jr. et al. | |
| 6,054,022 | A | 4/2000 | Helwig et al. | |
| 6,102,128 | A | 8/2000 | Bridgeman | |
| 6,129,879 | A | 10/2000 | Bersted et al. | |
| 6,265,082 | B1 | 7/2001 | Dunham et al. | |
| 6,274,647 | B1 | 8/2001 | Knight et al. | |
| 6,287,686 | B1 | 9/2001 | Huang et al. | |
| 6,287,690 | B1 | 9/2001 | Land | |
| 6,297,178 | B1 | 10/2001 | Berbner et al. | |
| 6,358,608 | B1 | 3/2002 | Hanyon et al. | |
| 6,397,401 | B2 | 6/2002 | Belcher | |
| 6,489,256 | B1 | 12/2002 | Kent et al. | |
| 6,497,787 | B1 * | 12/2002 | Geel | 162/158 |
| 6,823,548 | B2 | 11/2004 | Murphy et al. | |
| 6,858,550 | B2 | 2/2005 | Ahluwalia | |
| 2001/0021735 | A1 | 9/2001 | Schulz | |
| 2002/0034906 | A1 | 3/2002 | Berbner et al. | |
| 2003/0008978 | A1 | 1/2003 | Chen et al. | |
| 2003/0176125 | A1 | 9/2003 | Ahluwalia | |
| 2004/0060118 | A1 | 4/2004 | Diaz | |
| 2004/0060119 | A1 | 4/2004 | Murphy et al. | |
| 2004/0060120 | A1 | 4/2004 | Murphy et al. | |
| 2004/0197468 | A1 * | 10/2004 | Geel et al. | 427/180 |
| 2004/0198125 | A1 | 10/2004 | Mater et al. | |
| 2004/0219852 | A1 | 11/2004 | Eichhorn et al. | |
| 2004/0226100 | A1 | 11/2004 | Small et al. | |
| 2005/0023509 | A1 | 2/2005 | Bascom et al. | |
| 2005/0026528 | A1 | 2/2005 | Forsten et al. | |
| 2005/0095936 | A1 | 5/2005 | Jones et al. | |
| 2006/0068675 | A1 | 3/2006 | Handermann | |

FOREIGN PATENT DOCUMENTS

| | | |
|---|---|---|
| EP | 93965 | 1/1988 |
| EP | 355193 | 2/1990 |
| EP | 355760 | 2/1990 |
| EP | 221330 | 1/1991 |
| EP | 408947 | 1/1991 |
| EP | 622332 | 11/1994 |
| EP | 1 174 541 A2 | 1/2002 |
| GB | 1452629 | 10/1976 |
| GB | 2104929 | 3/1983 |
| GB | 2245606 | 1/1992 |
| JP | 52-144470 | 12/1977 |
| KR | 2002-074868 | 10/2002 |
| WO | 01/53578 | 7/2001 |
| WO | 03/008042 | 1/2003 |
| WO | 2006/014859 | 2/2006 |
| WO | 2006/026755 | 3/2006 |

OTHER PUBLICATIONS

International Search Report and Written Opinion from PCT/US05/31374 dated Jul. 13, 2006.

Office action from U.S. Appl. No. 11/216,720 dated Dec. 5, 2007.

Office action from U.S. Appl. No. 11/216,720 dated Aug. 14, 2008.

Notice of Abandonment from U.S. Appl. No. 11/216,720 dated Apr. 10, 2009.

"A Guide to Fibers for Nonwovens", Nonwovens Industry, Jun. 1987, pp. 26-45.

BBC website, Halogen and Nonhalogen Flame Retarrdancy, the Thirteenth Annual BBC Conference on Flame Retardancy, Jun. 2-5, 2002, 3 pages.

Bureau of Home Furnishings and Thermal Insulation website, date unknown, available as of filing date, 2 pgs.

California Test Bulletin 129 "Flammability Test Procedure for Mattresses for use in Public Buildings", Oct. 1992, pp. 1-31.

Drelich, A., "Nonwoven Textile Fabrics: Staple Fibers", in Encyclopedia of Chemical Technology, 3rd Ed., vol. 16, Jul. 1984, pp. 104-124, New York.

Joseph, M.L., Introductory Textile Science, 5th Ed. 1986, pp. 130-134, Holt, Rinehart and Winston, New York.

Porter, K., "Nonwoven Textile Fabrics: Spunbonded", in: Encyclopedia of Chemical Technology, 3rd Ed., vol. 16, Jul. 1984, pp. 72-104, New York.

Oy, Sateri, website, 10 pages, date unknown, available as of filing date.

Oy, Sateri, Brochure: VISII Technical Information, Valkeakoski, Finland, 44 pgs. Date unknown, available as of filing date.

State of California Dept. Of Consumer Affairs, Technical Bulletin 133: Flammability Test Procedure for Seating Furniture for use in Public Occupancies, Jan. 1991, pp. 1-28.

State of California Department of Consumer Affairs Bureau of Home Furnishings and Thermal Insulation Bulletin 603, "Rfequirements and Test Procedure for Resistance of a mattress/box spring set to a large open-flame", dated Jan. 2004.

Turbak, Albin F., "Non-wovens: Theory, Process Performance, and Testing", 1st Ed. pp. 139-151 (1993), Tappi Press, Atlanta, GA.

* cited by examiner

FIBERGLASS PRODUCTS FOR REDUCING THE FLAMMABILITY OF MATTRESSES

CROSS REFERENCE TO RELATED APPLICATIONS

This application is related to and claims domestic priority benefits from U.S. Provisional Patent Application Ser. No. 60/592,990 entitled "Fiberglass Products For Reducing The Flammability of Mattresses" filed Jul. 30, 2004, the entire content of which is expressly incorporated herein by reference.

TECHNICAL FIELD AND INDUSTRIAL APPLICABILITY OF THE INVENTION

The present invention relates generally to fiberglass products and more particularly to glass fiber products that are used to reduce the flammability of mattresses and upholstery.

BACKGROUND OF THE INVENTION

Fire hazards associated with mattresses are well-known. Many individuals have been severely injured or have died in fires that started in, or were fueled by mattresses. Conventional mattresses typically contain a number of potentially volatile components that can ignite or fuel a fire. For example, the layer of ticking on a mattress is generally flammable, and can be ignited such as by a smoldering cigarette, a pipe, a cigar, a candle, a tipped over lamp, or a faulty electric socket. In addition, the foam within the mattress used for cushioning is combustible and may provide fuel for the fire. Pockets or cavities of air within the mattress provide oxygen for the combustion of mattress materials. Pillow-tops found on some mattress provide an additional layer of filling material that can be ignited. Moreover, the pillow-tops are typically set off from the mattress by gussets, which can create thin lines of highly volatile fill materials and add gaps and crevasses that can trap and concentrate the heat of the flames.

The springs found in traditional mattresses are normally held under compression by the mattress materials. However, once a fire consumes the external mattress materials, the springs may burst the mattress open and fully expose the flammable materials inside the mattress to the fire, thereby accelerating the fire. In addition, conventional methods of assembling mattresses produce seams that can split open and subject the internal cushioning material to the flames. The heat from the combustion of flammable mattress materials, such as, for example, the polyurethane foam cushioning material, produces noxious, toxic and/or combustible gases. As the temperature within the room rises, a "flashover" event may occur where the combustible gases ignite and engulf the entire room in flames.

Numerous attempts have been made to reduce the flammability of mattresses. One method has been to treat fabrics used in their construction with chemical flame retardants. However, chemical treatments may release undesirable odors and may cause skin irritation in some individuals. In addition, the chemical treatments may cause the fabric to be stiff and uncomfortable.

Another method is to form the mattress from non-flammable materials, such as, for example, certain forms of fiberglass. However, previously used forms of fiberglass may break over time. When these fibers break, they are very small and may not be removed from the linen simply by washing the bedding. Thus, once the fiberglass begins to break, the linen on the mattress will likely need to be replaced to remove the broken fibers. Flame resistant fibers or charring fibers such as silica modified rayon (Visil®), modacrylic, or melamine fibers can be produced in a batting or lofted material to provide flame resistance and insulation to the mattress. When a batting is used, as much as two times the fibrous batting required for cushioning the mattress is necessary to provide flame resistance. A mattress formed with this excess batting may be difficult to sew and manufacture, thus potentially raising the costs.

A further method to reduce the flammability of mattresses is to use specially constructed mattresses that have internally disposed elements such as liquid filled cells or non-flammable padding. However, such specially constructed mattresses are relatively high in cost.

Specific examples of attempts to fire-retard or fireproof mattresses are set forth below.

U.S. Pat. No. 3,670,348 to Irwin discloses the use of a fiberglass pad inside the ticking to enclose the combustible portion of the mattress. The fiberglass pad does not contain an organic binder. However, the fiberglass pad does not create a soft, comfortable surface. In addition, individual glass fibers may break off of the fiberglass pad and penetrate the surface of the mattress. These glass fibers may cause irritation and/or discomfort to the individual in contact with the mattress.

U.S. Pat. No. 3,818,521 to Richards discloses a heat conducting metallic foil positioned between the ticking and padding layers. The foil serves to prevent the flammable cloth ticking material from bursting into flame when the ticking is subjected to temperatures above which combustion would normally occur by conducting the heat away.

U.S. Pat. No. 4,092,752 to Dougan describes a mattress that has a core of a flame retarded polyurethane foam and an optional outer layer of a flexible polyimide foam. The foam core is enclosed in a flame retardant ticking. The box spring for use in conjunction with the flame retardant mattress has a non-combustible frame. The box spring may be padded with the same flame retarded polyurethane foam used in the mattress.

U.S. Pat. No. 4,430,765 to Karpen discloses a mattress that has a plastic impregnated water resistant ticking. The filling for the mattress is a cotton felt blended with a boric acid powder that will not support combustion under direct flame exposure.

U.S. Pat. No. 4,443,903 to Leitner describes a flame retardant composition that includes an aminophosphonate ester in combination with a thermosetting, nitrogen-containing resin. The composition preferably also contains a reactive elasatomeric latex.

U.S. Pat. No. 4,504,991 to Klancnik describes a mattress that includes a layer of a fire retardant material bonded (e.g., neoprene foam) to a layer of a high tensile strength material (e.g., fiberglass). When exposed to fire, the fire retardant material forms a char which creates a heat shield to protect the inside of the mattress from the flames.

U.S. Pat. No. 6,823,548 and U.S. Patent Publication No. 2004/0060120 to Murphy et al. disclose a composite barrier fabric that includes a fire barrier layer and a thermally insulating layer. Both the fire barrier layer and the thermally insulating layer include at least one flame retardant fiber. The composite barrier fabric is used to at least partially cover the core or filling of a mattress.

U.S. Patent Publication No. 2004/0226100 to Small, Jr. et al. describes a mattress that includes a core and a barrier material surrounding the core. The barrier material includes flame and heat resistant fibers such as glass, asbestos, modacrylic, carbon, polyphenylene, benzobisoxazole, melamines, and polyimides. Synthetic fibers such as polyester may be blended to improve strength and/or dimensional stability of the barrier material. The barrier material may also include an intumescent material.

U.S. Patent Publication No. 2005/0023509 to Bascom et al. describes a single layer nonwoven fabric for use as a fire-blocking component in a mattress. The nonwoven fabric includes a cellulose fiber that retains at least 10% of its fiber weight when heated in air to 700° C. at a rate of 20° C. per minute (e.g., Visil®) and an organic fiber that retains 90% of its fiber weight when heated in air to 500° C. at a rate of 20° C. per minute (e.g., Kevlar®D fibers). The nonwoven fabric may also include a gassing material such as a modacrylic fiber or polyvinylchloride fibers.

U.S. Patent Publication No. 2005/0026528 to Forsten et al. discloses a fabric composite for use in fireblocking a mattress. The fabric composite includes a sacrificial outer ticking, a sacrificial cushioning material, and a fire-blocking fabric composed of a single layer of a nonwoven fabric. The nonwoven fabric is formed of a cellulose fiber that retains at least 10% of its fiber weight when heated in air to 700° C. at a rate of 20° C. per minute and a heat resistant fiber (e.g., Kevlar® fibers).

U.S. Patent Publication No. 2005/0095936 to Jones et al. describes a composite upholstery panel that includes a layer of ticking fabric, a layer of flame and heat resistant backing fabric, and a layer of resilient flame and heat resistant cushioning material positioned between the ticking and backing fabric. The cushioning material may be formed of flame resistant fibrous materials such as aramid, modacrylic, silica modified rayon, FR rayon, FR polyester, melamine carbon, and blends thereof. The backing layer may be formed of a fibrous material that has been treated with a flame retardant material. The ticking layer is a decorative layer of strong fabric and may be a knit or woven fabric formed from a flame resistant material or coated with a flame resistant material.

The high incidence of mattress fires throughout the United States has caused the formation of committees to establish standards for the testing flammability of mattresses. One example of these new standards to reduce flammability of mattresses used in homes is Assembly Bill 603 (TB 603) which was passed in the California Legislature Assembly and is incorporated herein by reference in its entirety. The bill requires that all mattresses and sleep surfaces sold in the state of California meet an open flame resistance standard as of Jan. 1, 2005. Other states are following California's example and have placed similar testing requirements before their legislatures. Although previous attempts to reduce flammability have, in some instances, been partly successful, there are few mattress that are capable of reducing flammability to a level that will meet the newest flammability standards, such as the open flame requirements of TB 603, and still meet desired comfort levels and cost restrictions.

Thus, there exists a need in the art for a mattress that meets the stringest flammability requirements, is low cost, and retains the comfort properties of traditional mattresses.

SUMMARY OF THE INVENTION

An object of the invention is to provide a nonwoven fibrous veil that is used as a fire retardant for a mattress or upholstery. In one embodiment, the fibrous mat is placed on the bottom of a mattress to inhibit the penetration of flames into the combustible foam cushioning material located inside the mattress. However, placing the veil on any or all sides of the mattress as well as on the top and/or bottom of the mattress is within the purview of the invention. The veil is formed by a wet-laid process known to those of ordinary skill in the art. The glass fibers within the veil may have a diameter of from about 6.5-25 microns and a length of from about 6-75 mm. The binder composition used in the wet-laid process preferably includes an acrylic binder formed of a polyacrylic acid and at least one polyol. The binder may have a low glass transition temperature to provide a soft fabric finish to the final veil product. The glass transition temperature of the binder is preferably 20° C. or lower. The binder may also include a flame retardant additive such as antimony trioxide. The fibers in the veil may be formed entirely of glass fibers. It is preferred, however, that the veil contain about 30-40% glass fibers. In addition, the mat may contain up to 30% of a comfort enhancing fiber (e.g., polyester fibers). The remainder of the fibers in the veil may be composed of synthetic fibers including but not limited to polyvinyl chloride (PVC), modacrylic, and/or Visil® fibers.

It is also an object of the invention to provide a fire retardant composite that includes an encapsulating layer, a fire retardant veil, and a backing layer. The backing layer may be a spunbond, needle punched, or stitchbond polyester or polypropylene nonwoven or woven fabric. The encapsulating layer may be a thin layer of a thermoplastic polymer extrusion coated directly onto the veil or a preformed thermoplastic film or laminate that is adhered to the veil. Preferably, all of the fibers present in the veil are glass fibers. However, if the fibers present in the veil contain less than 100% glass fibers, the remainder of the fibers may include synthetic fibers such as polyester, FR polyester, polyamide, aramid, polyvinyl chloride (PVC), PVAC (a blend of polyvinyl chloride and polyvinyl acetate), melamine (e.g., Basofil®), modacrylic, Visil®, nylon, rayon, and/or acetate. The fire retarding composite may be formed in-line as a "one-piece" composite which may then be attached to the cushioning material of the mattress such that the backing layer faces externally (i.e., the side that is viewed by consumers). Alternatively, the backing, the veil, and the encapsulating layer may be sequentially layered on the cushioning material of the mattress and affixed to each other on the mattress. It is envisioned that the fire retarding composite could be positioned on the top, and/or bottom, and/or sides of the mattress.

Another object of the present invention is to provide a glass fiber insulation product that is used to reduce the flammability of a combustible article, such as a mattress or upholstery. In at least one embodiment of the invention, the insulation product is placed on the sides of a mattress. However, it is within the purview of the invention to place the insulation product on any of the sides of the mattress, including the top and/or the bottom. The insulation product may be formed by methods known to those of skill in the art. The insulation product may be formed of any type of glass fibers, such as A-type glass fibers, C-type glass fibers, E-type glass fibers, S-type glass fibers, and modifications thereof. Optionally, synthetic fibers such as, but not limited to, polyester, FR polyester, polyamide, aramid, polyvinyl chloride (PVC), PVAC (a blend of polyvinyl chloride and polyvinyl acetate), melamine (e.g., Basofil®), modacrylic, visil, and mixtures thereof may be present in the insulation product in addition to the glass fibers. The glass fibers preferably have a diameter of from about 3 to about 6 microns and a length of from about ½ of an inch to about 1½ inches. The small diameter of the glass fibers gives the final insulation product a soft feel. The insulation product may have a thickness of less than or equal to one inch. The binder composition used in forming the insulation product is a formaldehyde free binder, preferably a polycarboxylic acid based binder.

A further object of the invention is to provide a method of reducing the flammability of a combustible article by placing a glass fibrous product on at least a portion of the combustible article. The glass fibrous product includes the nonwoven fibrous veil and/or glass fiber insulation product described above. The combustible article may be a mattress or upholstery, such as a chair, sofa, or futon. For example, the glass fiber product may be placed on the top, bottom, and/or one or more sides of the article, such as a mattress to reduce the flammability of the mattress.

It is an advantage of the invention that the fire retarding veil and the glass fiber insulation product described above reduce the flammability of a mattress while maintaining the comfort level of traditional mattresses.

It is a further advantage of the invention that the fire retardant veil and glass insulation product are inexpensive to manufacture.

It is yet another advantage of the invention that the fire retardant veil and insulation product are easy to sew into mattresses and/or furniture.

It is a further advantage of the invention that the fire retardant veil and the insulation product meet stringent open flame tests.

It is also an advantage that the fire retardant veil and the insulation product are flexible.

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

DETAILED DESCRIPTION AND PREFERRED EMBODIMENTS OF THE INVENTION

Figure 1:
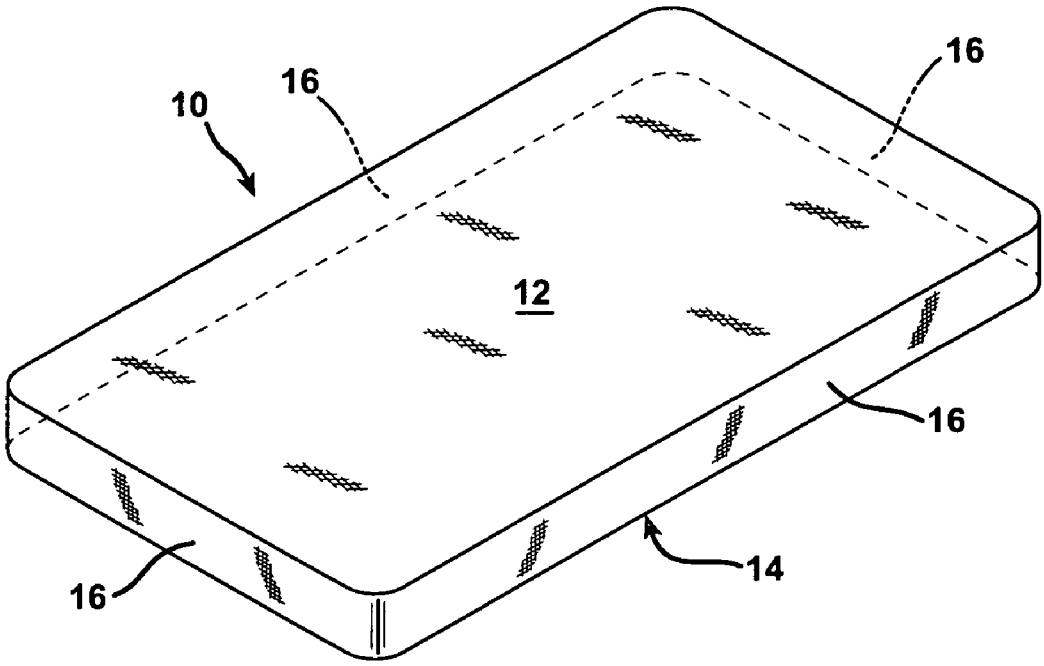
FIG. 1 PRIOR ART
FIG. 1 is a perspective view of a conventional mattress.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein. All references cited herein, including published or corresponding U.S. or foreign patent applications, issued U.S. or foreign patents, or any other references, are each incorporated by reference in their entireties, including all data, tables, figures, and text presented in the cited references. It is to be noted that like numbers found throughout the figures denote like elements. It is also to be noted that the terms "mat" and "veil" are used interchangeably herein. It is to be further noted that the phrase "sizing composition", "size composition", and "size" may be used interchangeably herein.

The present invention relates to glass fiber products that may be used to reduce the flammability of mattresses. In particular, a glass mat or a fiberglass insulation product may be incorporated as part of the mattress to prohibit or retard the migration of flames into the internal foam cushioning. The glass fiber products of the present invention both reduce the flammability of the mattresses and maintain the comfort level of traditional mattresses.

In at least one embodiment of the present invention, a veil is used to reduce the flammability of a mattress. The veil may be formed by conventional wet-laid methods known to those of skill in the art. For example, the veil may be formed by attenuating streams of a molten glass material from a bushing or orifice to form glass fibers. The molten glass may be attenuated by a winder which collects or gathers the fibers into a package or by rollers which pull the fibers before they are collected and chopped. An aqueous sizing composition may be applied to the fibers after they are drawn from the bushing to protect the fibers from breakage during subsequent processing, to retard interfilament abrasion, and to ensure the integrity of the strands of glass fibers, e.g., the interconnection of the glass filaments that form the strand. Sizing compositions are well-known in the art, and typically include a film forming polymeric or resinous component, a coupling agent, and a lubricant. The sizing composition used in the present invention is not particularly limited, and may be a conventional sizing known to those of ordinary skill in the art.

After the fibers are treated with the sizing composition, they may be chopped and packaged in their wet condition as wet use chopped strand glass (WUCS). The wet use chopped strand glass fibers have a moisture content of from 5-30%, and preferably have a moisture content of from 5-20%. The fibers may have a length of from approximately 6-75 mm, and preferably have a length of from about 6-25 mm. In addition, the diameter of the glass fibers may range from about 6.5-25 microns, preferably from about 6.5-16 microns. The small diameter of the glass fibers helps to impart a soft feel to the veil. It is to be appreciated that the fire retardant veils of the present invention are also flexible.

The wet, chopped glass fibers are then dispersed in a water slurry which may contain surfactants, viscosity modifiers, or other chemical agents, and agitated to disperse the fibers. The slurry containing the dispersed fibers is then deposited onto a moving screen where a substantial portion of the water is removed to form a web. A binder composition is then applied, and the resulting veil or mat is heated to remove the remaining water and cure the binder. The formed nonwoven veil is an assembly of dispersed, individual glass filaments.

The binder composition may be a binder such as an acrylic binder, a styrene acrylonitrile binder, a styrene butadiene rubber binder, or mixtures thereof. Preferably, the binder is a standard thermosetting acrylic binder formed of polyacrylic acid and at least one polyol (e.g., triethanolamine or glycerine). Examples of suitable acrylic binders for use in the present invention include GL 618 (Rohm & Haas), Rhoplex HA-12 (Rohm & Haas), Rhoplex B-959 (Rohm & Haas), Rhoplex B-15J (Rohm & Haas), Rhoplex NW-1402 (Rohm & Haas), Reynco 124-45A (Reynolds Company), Reynco 124-45B (Reynolds Company), Reynco 124-16C, and mixtures thereof. The binder may be supplied to the fibers at a rate such that the final product contains approximately 20-30% by weight binder.

In addition, the binder may have a low glass transition temperature (Tg) to assist in providing a soft fabric finish to the veil and reduce irritation. The glass transition temperature of the polymeric binder has an effect on the rigidity and flexibility of the treated veil. Glass transition temperatures of the binder, as calculated by the Fox equation, may be 20° C. or lower. In at least one exemplary embodiment, the glass transition temperature of the binder ranges from about −10° C. to about 10° C.

The binder composition also preferably includes a flame retardant. Non-limiting examples of suitable flame retardants that may be used in the binder composition include phosphorous-based flame retardants such as nitrogen phosphorous and phosphate; aluminum trihydrate; magnesium hydroxide; calcium hydroxide; calcium carbonate; antimony trioxide; boron salts; halogenated flame retardants; melamine-based flame retardants; and mixtures thereof. The flame retardant may be present in the binder composition in an amount up to 20% by weight of the binder composition.

The binder composition may optionally contain conventional additives such as dyes, oils, fillers, thermal stabilizers, emulsifiers, anti-foaming agents, anti-oxidants, organosilanes, colorants, UV stabilizers, and/or other conventional additives. Other additives may be added to the binder composition for the improvement of process and product performance. Such additives include coupling agents (e.g., silane, aminosilane, and the like), dust suppression agents, lubricants, wetting agents, surfactants, antistatic agents, and/or water repellent agents.

Any type of glass fibers, such as A-type glass fibers, C-type glass fibers, E-type glass fibers, S-type glass fibers, ECR-type glass fibers (e.g., Advantex® glass fibers commercially available from Owens Corning), or modifications thereof can be used to form the fire retardant veil. In addition to glass fibers, synthetic fibers such as, but not limited to, polyester, FR polyester, polyamide, aramid, polyvinyl chloride (PVC), PVAC (a blend of polyvinyl chloride and polyvinyl acetate), melamine (e.g., Basofil®), modacrylic, Visil® (a silicic acid modified rayon), nylon, rayon, acetate, and mixtures thereof may be used. The fibers forming the veil may be entirely glass fibers. Such a veil would be both inexpensive and flame resistant. However, glass fibers have the potential to cause irritation to those who come into contact with the fibers. As a result, the veil typically includes non-glass fibers in addition to the glass fibers. To reduce the potential irritation to mattress manufacturers and to consumers that may be caused by the glass fibers, the veil may contain less than approximately 50% by weight glass fibers, and preferably less than 30-40% by weight glass fibers. As used herein, "% by weight" is meant to indicate % by weight of the final product.

One method used to increase the comfort level for the consumers and the mattress manufactures is to include at least one comfort enhancing fiber in the veil to help impart a soft feel to the veil. The comfort enhancing fiber is not particularly limited, and may be any fiber (synthetic or natural) that improves or increases the comfort and/or feel of the veil. Preferably, the comfort enhancing fiber possesses fire retarding properties. Non-limiting examples of comfort enhancing fibers include polyester, FR polyester, polyamide, aramid, polyvinyl chloride (PVC), and PVAC (a blend of polyvinyl chloride and polyvinyl acetate). In a preferred embodiment, the comfort enhancing fibers present in the veil are polyester fibers.

It is desirable to include as high a level of comfort enhancing fibers as possible in the veil for maximum comfort. Unfortunately, the comfort enhancing fibers alone will not provide enough fire resistance to reduce the flammability of the mattress. In at least one embodiment of the invention, the veil includes up to approximately 30% by weight comfort enhancing fibers (e.g., polyester fibers). At this amount, the comfort level of the veil is improved and the fire retarding qualities of the veil are not compromised. Thus, in at least one embodiment of the invention, the veil contains up to approximately 30% by weight of the binder composition, up to approximately 40% by weight glass fibers, and up to approximately 30% by weight comfort enhancing fibers. The remainder of the fibers in the veil may be a combination of synthetic fibers such as, but not limited to, the synthetic fibers listed above (e.g., PVC, modacrylic, and Visil® fibers). The synthetic fibers may be the same as the comfort enhancing fiber. The synthetic fibers possess fire retarding properties which help to maintain the fire retarding properties of the veil even with a reduced amount of glass present in the veil. In addition, some synthetic fibers such as modacrylic and polyvinylchloride fibers (PVC) remove oxygen from the air when burned, thereby providing a self-extinguishing feature to the veil.

Figure 2:
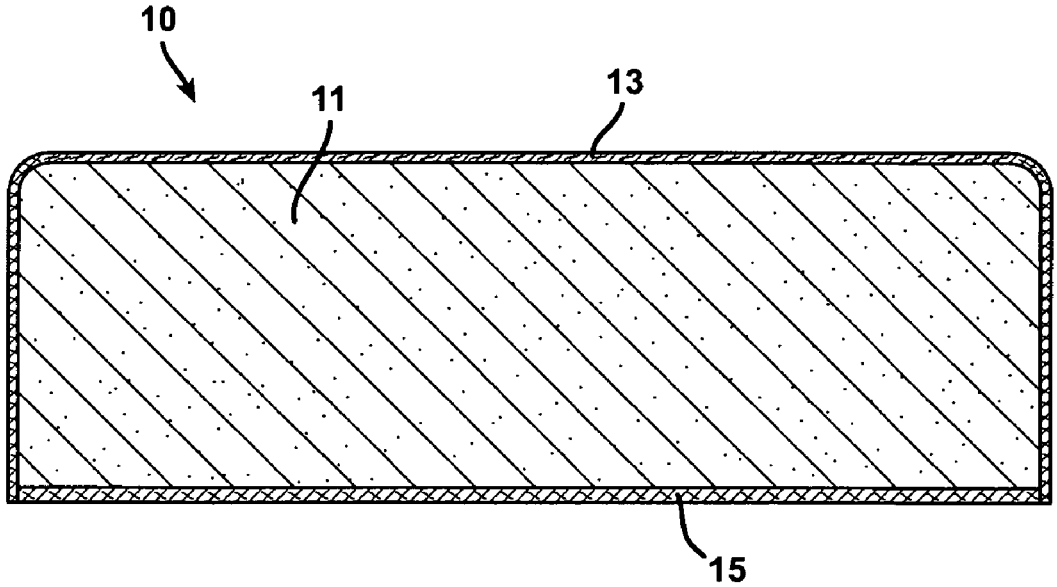
FIG. 2 PRIOR ART
FIG. 2 is a cross-sectional view of a conventional no-flip mattress.

A conventional mattress 10, as shown in FIG. 1, has a top 12 and a bottom 14 that represent a first major surface and a second major surface respectively. The mattress 10 also includes four sides 16 that interconnect the top 12 and the bottom 14. As shown in more detail in FIG. 2, the mattress 10 may include a cushioning core material 11, such as a polyurethane foam, batting, or other lofty material, to give the mattress a soft feel. Optionally, a foam core material (not shown) may be present within the cushioning material 11 to provide additional support to the mattress 10. The cushioning material 11 is typically highly flammable, and may be subject to combustion if the temperature of the cushioning material reaches its combustion temperature. A decorative ticking 13 at least partially surrounds the internal cushioning material 10 and is generally the external layer of the mattress that is viewed by consumers. The ticking 13 may be a knit or woven fabric, and may optionally encompass the entire mattress 10. As depicted in FIG. 2, in a "no-flip" mattress, the ticking layer 13 may be absent from the bottom 14 and a backing layer 15 formed of a polyester or polypropylene nonwoven fabric may be positioned on the bottom (backside) 14 of the mattress 10. The decorative ticking 13 and backing layer 15 may be affixed to the cushioning material 11 by sewing, quilting, or gluing the layers together. The thread used to sew the individual layers together is preferably a fire-resistant material such as a Kevlar®, glass, or Nomex® thread. A pattern of stitches (not illustrated) may be provided on the ticking layer 13 to provide a decorative and aesthetically pleasing surface.

Figure 3:
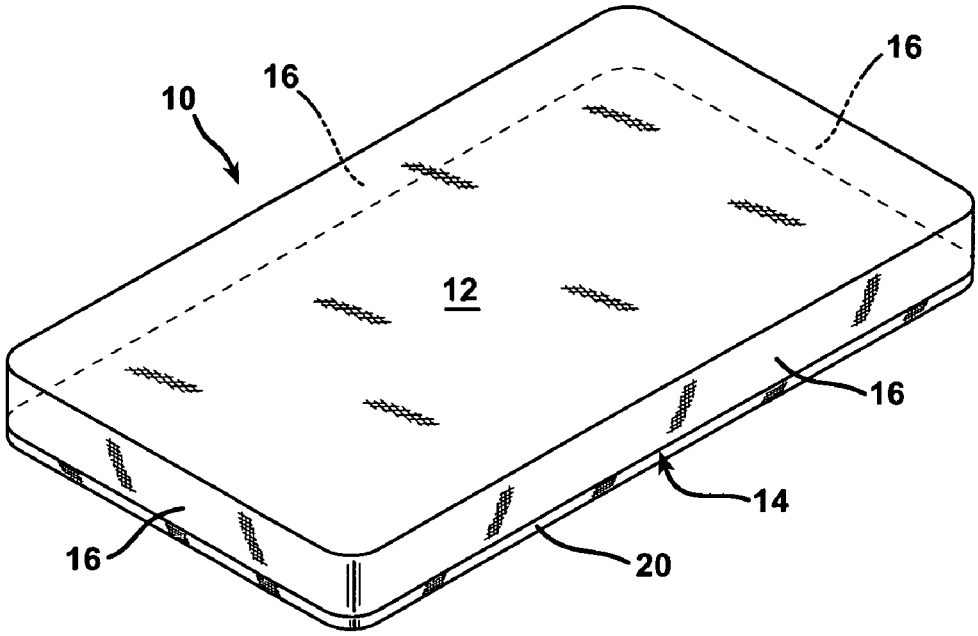
FIG. 3 is a perspective view of a mattress with a fire retarding veil positioned on a bottom side according to at least one embodiment of the present invention.
Figure 4:
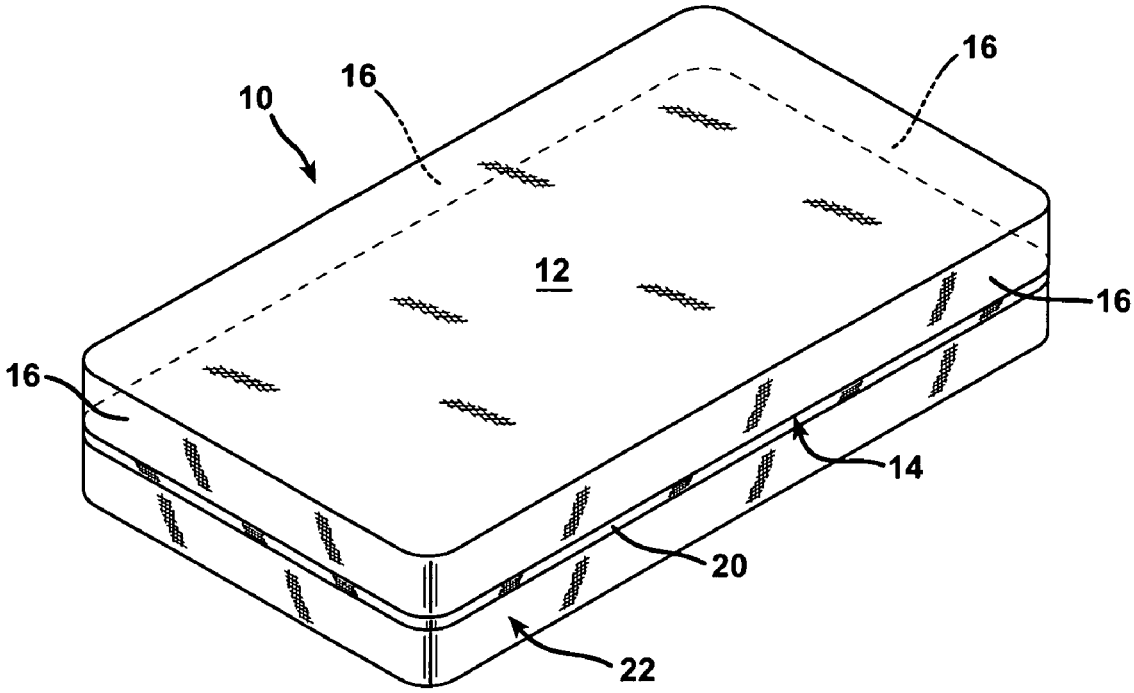
FIG. 4 is a perspective view of a mattress and a box spring with a fire retarding veil positioned a bottom side of the mattress between the mattress and the box spring according to at least one embodiment of the present invention.

Turning to FIG. 3, a mattress 10 having a fire retardant veil 20 affixed to the bottom 14 of the mattress 10 can be seen. The veil 20 may be positioned on or under the backing layer 15 of the mattress 10. Alternatively, the veil 20 may be placed under the ticking 13 in cases where the ticking 13 surrounds the mattress 10 (not shown in FIG. 3). When the veil 20 is affixed to the bottom 14 of the mattress 10, there is a prevention or reduction in the occurrence of flames extending through the bottom 14 of the mattress 10 to the cushioning material 11 and igniting the cushioning material 11. Although FIG. 3 depicts the fire retardant veil 20 on only one major surface (i.e., the bottom 14) of the mattress 10, positioning the veil 20 under the ticking 13 on the top 12 and/or bottom 14 as well as on any one or all of the sides 16 of the mattress 10 is within the purview of the present invention. If a separate box spring 22 is required for the mattress, as depicted in FIG. 4, the veil 20 may be positioned on the bottom 14 of the mattress 10 and/or the top (not shown) of the box spring 22. It is also envisioned that the veil 20 could be placed on the sides and/or the bottom box spring 22.

Attempts have been made in the past to encapsulate the cushioning material with fire blocking layers and to compress and/or otherwise restrain the cushioning material to reduce flammability. The use of such conventional fire blocking layers and fire retarding techniques adds stiffness to the mattress and therefore reduces the overall comfort of the mattress. In addition, restraining the cushioning material gives the mattress poor tactile aesthetics. On the other hand, the fire retardant veil according to the present invention is a thin, wet-laid product that provides a reduction in the flammability of the mattress without hindering the comfort of the mattress. The low glass transition temperature of the binder and the small diameters of the glass fibers gives the veil a soft, fabric-like feel that is pleasing to both consumers and mattress manufacturers. In addition, the presence of comfort enhancing fibers such as polyester fibers in the veil enables the veil to be non-irritating despite the presence of glass fibers. The thinness of the fire retardant veil permits the veil to be easily attached to the internal cushioning such as by sewing, needlepunching, or by an adhesive.

Figure 5:
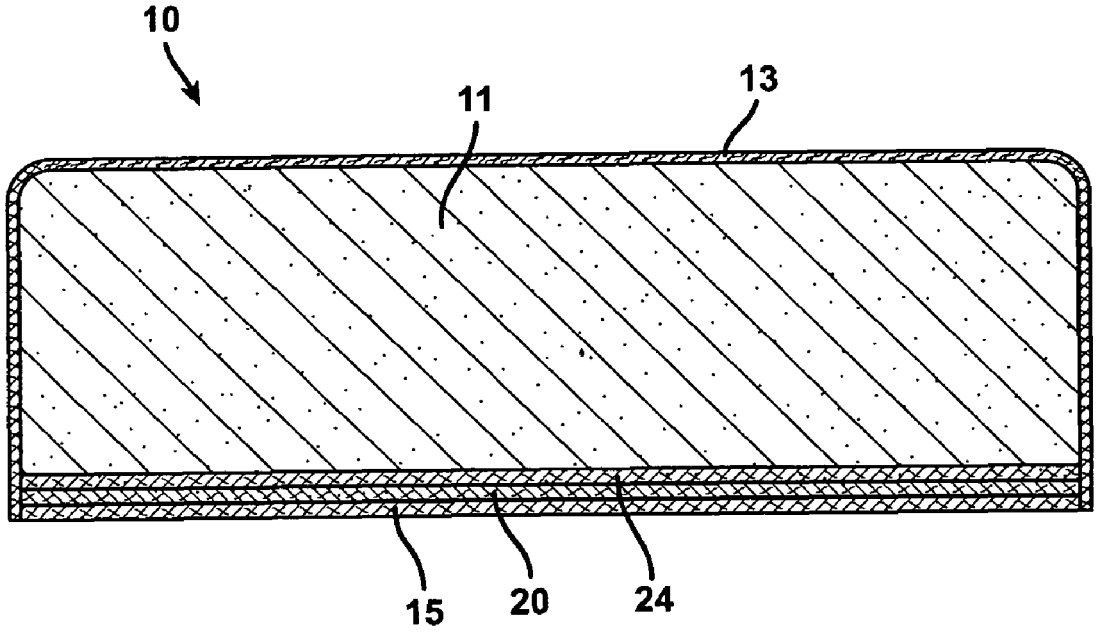
FIG. 5 is a cross-sectional view of a mattress including a fire retardant composite according to at least one exemplary embodiment of the present invention.

In an alternate embodiment shown in FIG. 5, the fire retardant veil is positioned on the backing 15 of a "no-flip" mattress 10, with the backing 15 facing externally (i.e., the side that is viewed by consumers). As with the embodiment described in detail above, the backing 15 may be a spunbond, needle punched, or stitchbond polyester or polypropylene fabric (woven or nonwoven). An encapsulating layer 24 is located on the veil 20 adjacent to the cushioning layer 11 such that the veil 20 is sandwiched between the backing layer 15 and the encapsulating layer 24.

The encapsulating layer 24 may be a thin layer of a thermoplastic polymer extrusion coated directly onto the veil 20. For example, the encapsulating layer 24 may be a thin film of polyethylene, polypropylene, polyester, and the like. Other useful methods of applying the polymeric encapsulating layer 24 include conventional lamination techniques such as extrusion, compression molding, and extrusion laminating. The encapsulating layer 24 may also be formed of a thin thermoplastic polymer film or laminate that has been pre-formed. In addition, the encapsulating layer 24 may be formed of a spunbond or needle punched nonwoven fabric or stitchbond woven fabric. This fabric may be formed of the same or similar material as the backing 15, but preferably has a heavier weight than the backing 15. The pre-formed polymeric film or nonwoven/woven fabric forming the encapsulating layer 24 may be needlepunched, laminated, or stitched to the veil 20. Alternatively, the polymeric film or nonwoven/woven fabric may be attached to the veil 20 via an adhesive.

In this alternative embodiment of the invention where an encapsulating layer 24 is present, the fibers forming the veil include a larger amount of glass fibers, such as, for example, up to 100% glass fibers. Preferably, all of the fibers in the veil 20 are glass fibers. Because glass fibers are extremely fire resistant and inexpensive to manufacture, a veil formed entirely of glass fibers prevents or reduces flames from igniting the internal cushioning material and is manufactured at low costs. Furthermore, a veil formed of all glass fibers eliminates the presence of costly synthetic fibers in the veil 20. If the fibers present in the veil 20 are less than 100% glass fibers, the remaining fibers present in the veil 20 may include synthetic fibers such as polyester, FR polyester, polyamide, aramid, polyvinyl chloride (PVC), PVAC (a blend of polyvinyl chloride and polyvinyl acetate), melamine (e.g., Basofil®), modacrylic, Visil®, nylon, rayon, and/or acetate.

Figure 6:
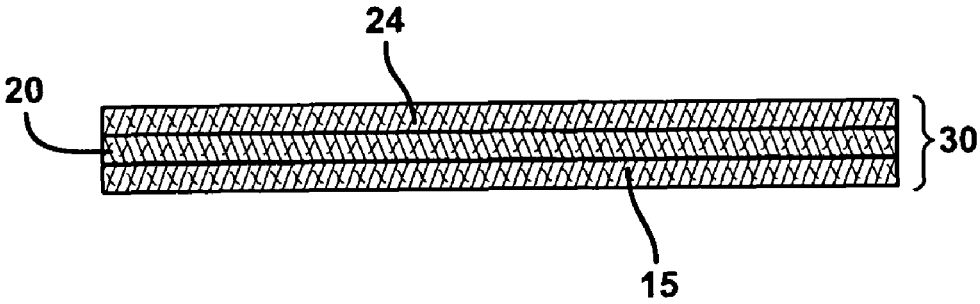
FIG. 6 is a cross-sectional view of a fire retardant composite in accordance with at least one exemplary embodiment of the present invention.

The backing 15, the veil 20, and the encapsulating layer 24 together form a fire retarding composite 30, depicted in FIG. 6. Assembly of the fire retarding composite 30 is not particularly limited as long as the individual layers are positioned on the bottom of the mattress 10 with the encapsulating layer 24 positioned against the cushioning material 11, the backing layer 15 facing externally (i.e., on the outside of the fire retarding composite), and the veil 20 sandwiched between the backing layer 15 and the encapsulating layer 24.

The fire retarding composite 30 may be formed in-line as a "one piece" composite 30 which may then be attached to the cushioning material 11 of the mattress 10. For example, the veil 20 and the backing 15 may be positioned together and passed through calendaring rolls so that an adhesive placed between the veil 20 and the backing 15 can melt and "glue" the veil 20 and the backing 15 together. As the veil 20 and the backing 15 pass through the calendaring rolls, heat is preferably applied to the veil side only. The encapsulating layer 24 may then be placed on the veil 20 by any of the methods described above (e.g. needlepunching, adhesive, etc.) to form the composite 30. In another example, the backing 15, the veil 20, and the encapsulating layer 24 are sequentially layered with an adhesive located between the layers. The backing 15, the veil 20, and the encapsulating layer 24 are then and passed through an oven where the adhesive melts and "glues" the backing layer 15, the veil 20, and the encapsulating 24 layer together and form the fire retardant composite 30. Alternatively, the backing 15, the veil 20, and the encapsulating layer 24 may be sequentially layered on the cushioning material 11 of the mattress 10 and affixed to each other on the mattress 10. It is envisioned that the fire retarding composite 30 could be positioned on the top 12, and/or bottom 14, and/or sides 16 of the mattress 10.

The fire retarding composite 30 is designed to prevent ignition of the cushioning material 11. In conventional mattresses, the backing layer 15 (e.g., a spunbond polypropylene) tends to shrink or melt away from a flame source. As the backing layer 15 shrinks away, it leaves weakened or exposed areas that may allow flames to enter the mattress and ignite the cushioning material 11. In the fire retardant composite 30, the veil 20 is affixed to the backing 15, prohibiting the backing 15 from shrinking away from the flame. As a result, the backing 15 melts and burns, leaving a layer of carbon behind. This carbon layer is unable to propagate the burning and thus acts as fire extinguishing layer. Further, the melted backing layer 15 acts as a glue to attach the backing layer 15 to an adjacent material or object, such as, for example, a box spring. This attachment helps to prevent oxygen from entering the mattress, which could provide a source for the combustion of the mattress materials. In addition, the presence of synthetic fibers such as modacrylic and polyvinylchloride fibers (PVC) that remove oxygen from the air when burned also provide fire extinguishing characteristics to the veil 20.

In addition to, or alternatively to, the flame resistant veil described above, a fibrous insulation product may be used to reduce mattress flammability. The fibrous glass insulation product is formed of matted glass fibers bonded together by a cured thermoset polymeric material. Suitable fibers used to form the insulation product include any type of glass fiber, including, but not limited to A-type glass fibers, C-type glass fibers, E-type glass fibers, S-type glass fibers, and modifications thereof. Optionally, synthetic fibers such as, but not limited to, polyester, FR polyester, polyamide, aramid, polyvinyl chloride (PVC), PVAC (a blend of polyvinyl chloride and polyvinyl acetate), melamine (e.g., Basofil®), modacrylic, visil, and mixtures thereof may be present in the insulation product in addition to the glass fibers.

The manufacture of the insulation product may be carried out by a continuous process by fiberizing molten glass and immediately forming a fibrous glass batt on a moving conveyor. For example, glass may be melted in a tank and supplied to a fiber forming device such as a spinner or bushing. Glass fibers of random lengths may be attenuated from the fiber forming device and blown downwardly within a forming chamber. The glass fibers may have a diameter from about 2 to about 9 microns and may have a length of from about ¼ of an inch to about 4 inches. Preferably, the glass fibers have a diameter of from about 3 to about 6 and a length of from about ½ of an inch to 1½ inches. The small diameter of the glass fibers gives the final insulation product a soft feel. Alternatively, the glass may be a cofiberized glass, such as Miraflex® insulation formerly sold by Owens Corning, as described in U.S. Pat. No. 5,723,216, which is incorporated herein by reference.

The fibers, while in transit in the forming chamber and while still hot from the drawing operation, are sprayed with an aqueous binder composition by suitable spray applicators so as to result in a distribution of the binder composition throughout the formed batt of fibrous glass. The glass fibers having the uncured resinous binder adhered thereto may be gathered and formed into a batt on a perforated endless conveyor within the forming chamber with the aid of a vacuum drawn through the batt from below the forming conveyor. The residual heat from the glass fibers and the flow of air through the fibrous mat during the forming operation are generally sufficient to volatilize a majority all of the water from the binder before it exits the forming chamber, thereby leaving the remaining components of the binder on the fibers as a viscous or semi-viscous high-solids liquid.

The coated fibrous batt, which is formed in a compressed state due to the tremendous flow of air through the mat in the forming chamber, is then transferred out of the forming chamber to a transfer zone where the mat vertically expands due to the resiliency of the glass fibers. The expanded batt is then heated, such as by conveying the batt through a curing oven where heated air is blown through the batt to evaporate any remaining water in the binder, cure the binder, and rigidly bond the fibers together. The cured binder imparts strength and resiliency to the insulation product.

Also, in the curing oven, the batt is compressed to form the final insulation product. Flights or rollers above and below the batt compress the batt to give the finished product a predetermined thickness of less than or equal to approximately 1 inch. The curing oven may be operated at a temperature from about 200° C. to about 325° C. Preferably, the temperature of the curing oven ranges from about 250° C. to about 300° C. The batt may remain within the oven for a period of time from about 30 seconds to about 3 minutes to sufficiently cure the binder, and preferably from about 45 seconds to about 1½ minutes.

Figure 7:
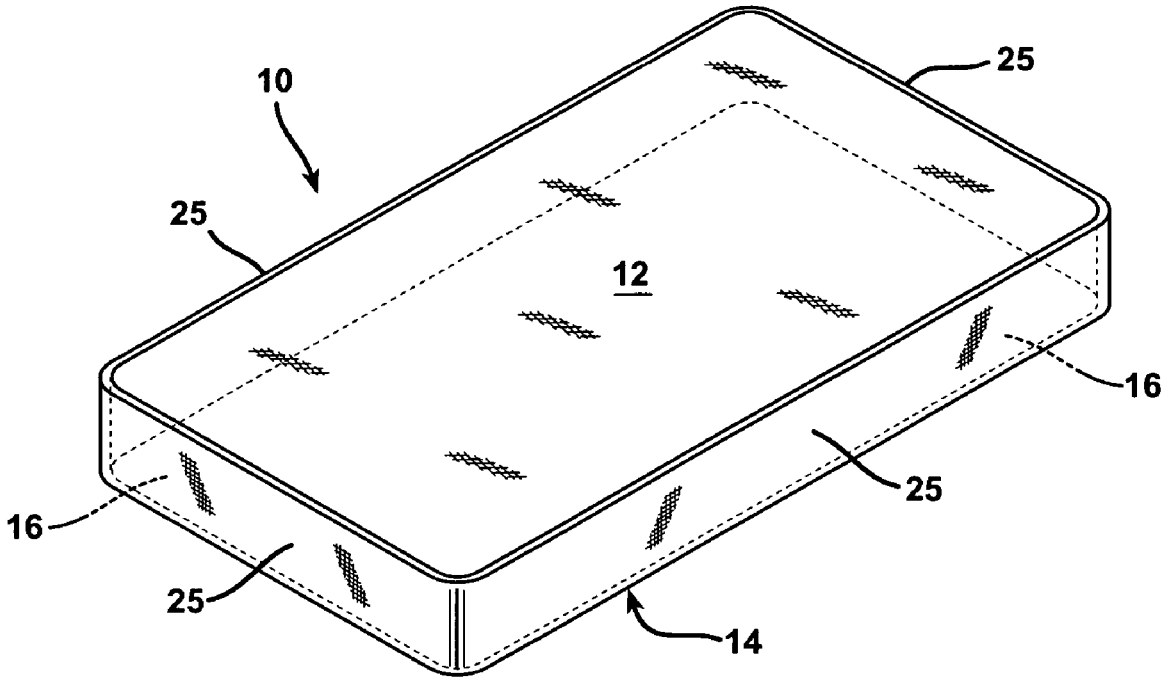
FIG. 7 is a perspective view of a mattress with a glass insulation product positioned on a side of a mattress according to at least one embodiment of the present invention.

As shown in FIG. 7, the insulation product 25 may be positioned on the sides 16 of a mattress 10 under the ticking. Any one or all of the sides 16 may be covered by the insulation product 25. Positioning the insulation product 25 on the sides 16 of the mattress 10 prohibits flames from penetrating the sides 16 of the mattress 10 and igniting the internal foam cushioning. In addition, the insulation product keeps the internal foam cushioning of the mattress at a temperature below its combustion temperature. Although not depicted in the figures, it is contemplated that the insulation product 25 could be positioned on the top 12 and/or bottom 14 of the mattress 10 as an alternative to or in addition to placing the insulation product on any one or all of the sides 16. In a further alternate embodiment (not shown), the insulation product may be sandwiched between two veils or a veil may be placed on the insulation product facing outward to provide additional comfort for the consumer. The veil may or may not be the fire retarding veil described above.

In the above-described insulation product, the binder is a formaldehyde-free binder composition. Preferably, the binder is a polycarboxylic based binder. The polycarboxy binder composition includes a polycarboxy polymer and a crosslinking agent. Optionally, the binder composition may include a catalyst. The binder may be present in an amount of from less than or equal to 10% by weight, and preferably in an amount of less than or equal to 5% by weight. The low amount of binder gives the final insulation product flexibility.

A suitable polycarboxy polymer for use in the binder composition is an organic polymer or oligomer that contains more than one pendant carboxy group. The polycarboxy polymer may be a homopolymer or copolymer prepared from unsaturated carboxylic acids including, but not limited to, acrylic acid, methacrylic acid, crotonic acid, isocrotonic acid, maleic acid, cinnamic acid, 2-methylmaleic acid, itaconic acid, 2-methylitaconic acid, and α,β-methyleneglutaric acid. Alternatively, the polycarboxy polymer may be prepared from unsaturated anhydrides such as maleic anhydride, itaconic anhydride, acrylic anhydride, methacrylic anhydride, and mixtures thereof. Methods for polymerizing these acids and anhydrides are easily identified by one of ordinary skill in the art.

In addition, the polycarboxy polymer may include a copolymer of one or more of the unsaturated carboxylic acids or anhydrides described above and one or more vinyl compounds including, but not limited to, styrene, α-ethylstyrene, acrylonitrile, methacrylonitrile, methyl acrylate, ethyl acrylate, n-butyl acrylate, isobutyl acrylate, methyl methacrylate, n-butyl methacrylate, isobutyl methacrylate, glycidyl methacrylate, vinyl methyl ether, and vinyl acetate. Methods for preparing these copolymers would be easily identified by those ordinarily skilled in the art.

In one exemplary embodiment, the polycarboxy polymer is a low molecular weight polyacrylic acid, preferably having a molecular weight ranging from about 500-10,000, prepared by polymerizing an acrylic acid monomer in water in the presence of a cure accelerator that contains an alkali metal salt of a phosphorous-containing inorganic acid as described in U.S. Patent Publication No. 2003/0008978 to Chen et al., which is incorporated herein by reference in its entirety. The polyacrylic acid may be phosphite-terminated. The cure accelerator used in this process may include sodium hypophosphite, sodium phosphate, potassium phosphate, disodium pyrophosphate, tetrasodium pyrophosphate, sodium tripolyphosphate, sodium hexamethaphosphate, potassium phosphate, potassium tripolyphosphate, sodium trimetaphosphate, sodium tetramethaphosphate, or mixtures thereof. The low molecular weight polyacrylic acid is subsequently reacted with a polyhydroxy crosslinking agent to form a binder composition. In the process disclosed by Chen et al., the molar ratio of hydroxyl groups in the polyhydroxy crosslinking agent to carboxylic acid groups in the polyacrylic acid may range from 0.4 to 0.6. It is to be noted that when the polycarboxy polymer is prepared in this manner, the polyacrylic acid can be crosslinked without the addition of a catalyst.

The binder composition utilized in the formation of the insulation product also includes a crosslinking agent. Crosslinking agents suitable for use in the binder composition include, but are not limited to, polyols that contain at least two hydroxyl groups, such as, for example, glycerol, trimethylolpropane, trimethylolethane, diethanolamine, triethanolamine, 1,2,4-butanetriol, ethylene glycol, glycerol, pentaerythritol, sorbitol, sucrose, glucose, resorcinol, catechol, pyrogallol, 1,3-propanediol, 1,4-butanediol, 1,6-hexanediol, 1,4-cyclohexane diol, 2-butene-1, erythritol, pentaerythritol, sorbitol, β-hydroxyalkylamides, trimethylol propane, glycolated ureas, and mixtures thereof. Preferably, the crosslinking agent is triethanolamine or glycerol.

The ratio of polycarboxy polymer to crosslinking agent may be determined by comparing the ratio of moles of hydroxyl groups contained in the polyol crosslinking agent to moles of carboxy groups contained in the polycarboxylic acid polymer. This stoichiometric ratio may vary over wide limits. The molar ratio of carboxylic acid groups from the polycarboxylic acid to the hydroxyl groups of the crosslinking agent may be from 1:3 to 5:1, preferably from 1:1 to 3:1. An excess of equivalents of carboxylic acid groups to the equivalents of hydroxyl groups is preferred.

Optionally, the binder composition includes a catalyst. The catalyst may be present in an amount of from 0-20% of the binder composition, preferably in amount of from 1-20%. The catalyst may include an alkali metal salt of a phosphorous-containing organic acid; in particular, alkali metal salts of phosphorus acid, hypophosphorus acid, or polyphosphoric acids. Examples of such phosphorus catalysts include, but are not limited to, sodium phosphite, potassium phosphite, disodium pyrophosphate, tetrasodium pyrophosphate, sodium tripolyphosphate, sodium hexametaphosphate, potassium phosphate, potassium polymetaphosphate, potassium polyphosphate, potassium tripolyphosphate, sodium trimetaphosphate, sodium tetrametaphosphate, and mixtures thereof. In addition, the catalyst may be a fluoroborate compound such as fluoroboric acid, sodium tetrafluoroborate, potassium tetrafluoroborate, calcium tetrafluoroborate, magnesium tetrafluoroborate, zinc tetrafluoroborate, ammonium tetrafluoroborate, and mixtures thereof. Further, the catalyst may be a mixture of phosphorus and fluoroborate compounds. Preferred catalysts include sodium hypophosphite, sodium phosphite, and mixtures thereof.

The binder composition may optionally contain conventional additives such as dyes, oils, fillers, thermal stabilizers, emulsifiers, anti-foaming agents, anti-oxidants, organosilanes, colorants, and/or other conventional additives. Other additives may be added to the binder composition for the improvement of process and product performance. Such additives include coupling agents (e.g., silane, aminosilane, and the like), dust suppression agents, lubricants, wetting agents, surfactants, antistatic agents, and/or water repellent agents.

Although the fire retardant veil and insulation product have been described above with respect to fire retarding mattresses, the veil and insulation product may also be used in other fire retarding or fireproofing applications. One such example includes upholstery applications, such as furniture. In such an application, the veil or insulation product described above may be placed under the decorative covering or fabric to reduce the flammability of the seat cushion, chair, sofa, and the like. As with the embodiment described above with respect to reducing the flammability of mattresses, the glass fiber product would retard or prohibit the advancement of a flame into the internal cushioning of the upholstery. The glass fiber products may also find use in an airplane seat, a car seat, in sleeping bags, futons, and the like.

One advantage of the fire retarding veil and the insulation product is that they effectively reduce flammability in the mattress while maintaining the comfort level of traditional mattresses. In addition, both the veil and the insulation product are inexpensive to manufacture. Another advantage of the veil and insulation product is that they are easy to sew into mattresses and/or furniture. Moreover, because both the veil and the insulation product are flexible, they can be placed around the sides of the mattress or around the contours of furniture. Further, both the veil and the insulation product meet stringent open flame tests, such as the new TB 603 open flame test.

Having generally described this invention, a further understanding can be obtained by reference to certain specific examples illustrated below which are provided for purposes of illustration only and are not intended to be all inclusive or limiting unless otherwise specified.

EXAMPLES

Examples 1-3 Testing Protocol

The following Examples 1-3 each followed the testing protocol set forth herein. A 12 inch by 12 inch sample of the product to be tested was positioned on a metal frame and held in place on three sides. A weight (approximately 1-2 pounds) was hung from the bottom of the sample to simulate the pull that would be exerted on the sample if it were contained in a mattress. A T-shaped burner head was positioned approximately 300 mm (1 foot) from the side of the sample. The flow rate of the propane gas through the burner was approximately 6.6 L/min. During testing, burner was permitted to burn for 50 seconds. An infrared gun was used to measure the temperature of the back of the sample. A measurement was taken every second from the ignition of the burner until the burner was turned off (i.e., 50 seconds).

Example 1

Figure 8:
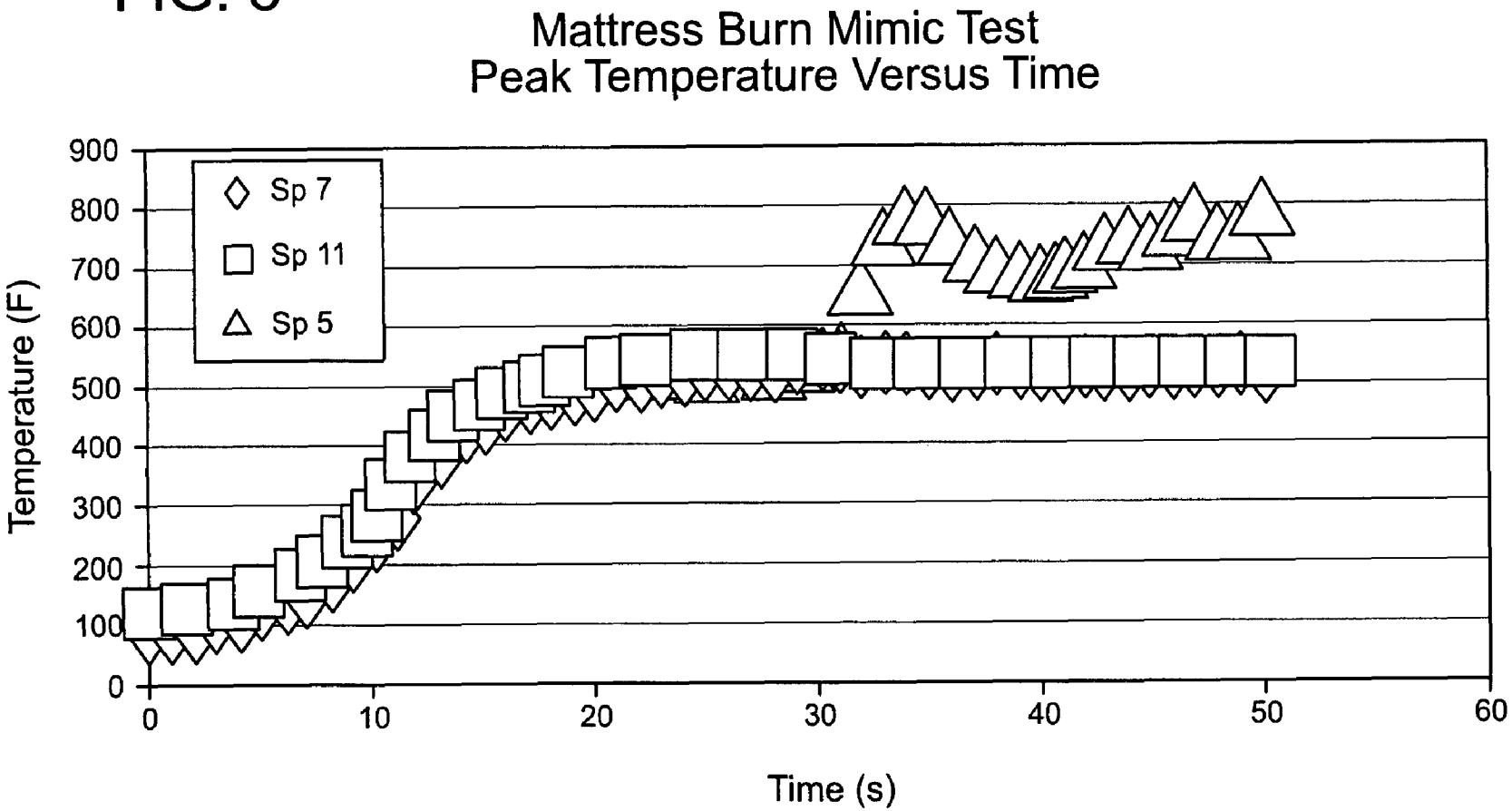
FIG. 8 is a graphical illustration of temperature versus time of a burn mimic test of veils produced in accordance with the present invention.
Figure 9:
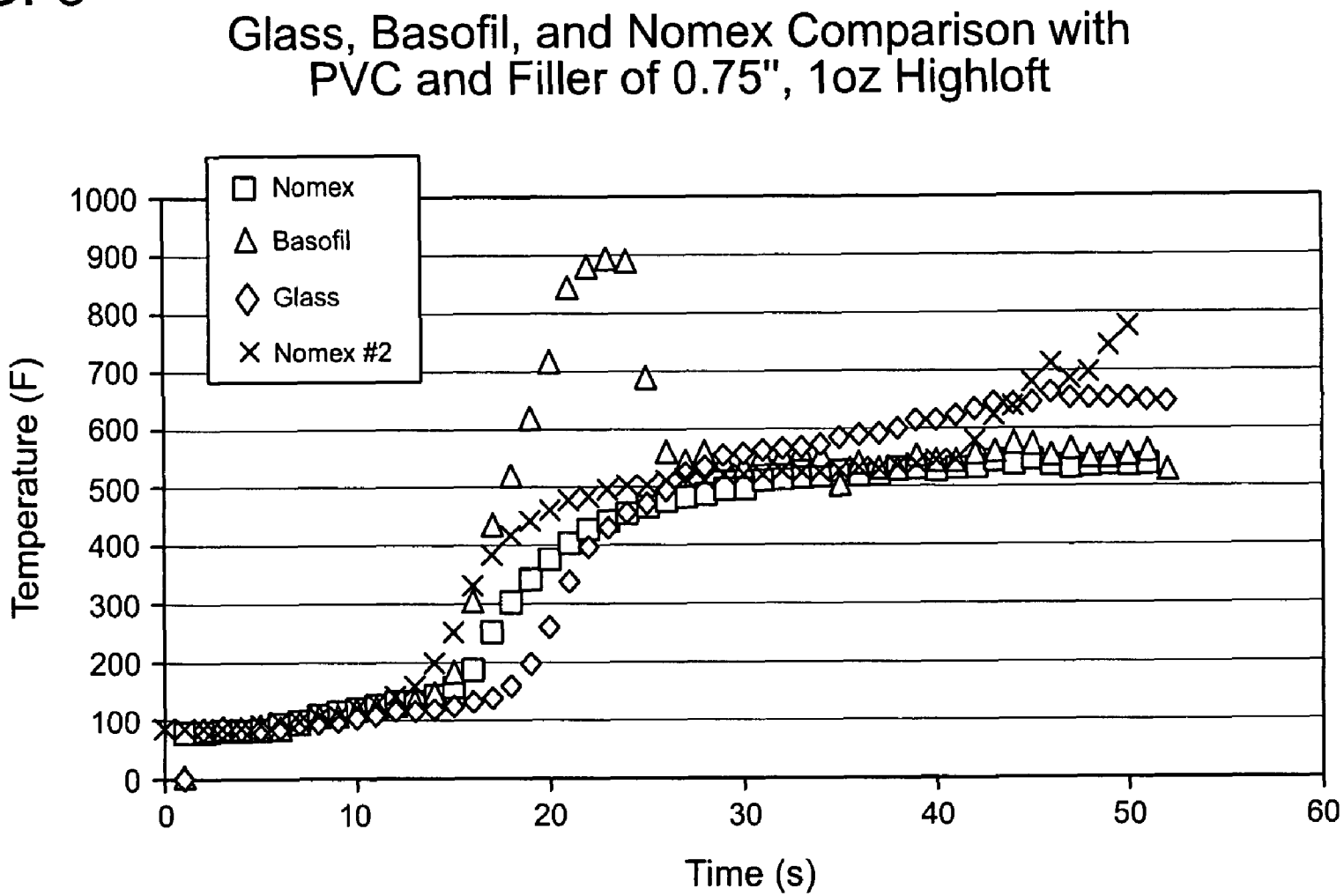
FIG. 9 is a graphical illustration of temperature versus time of veils formed of various glass fibers and PVC with a high loft filler according to at least one embodiment of the invention.

A veil composed of aramid, glass, and polyester fibers (diamond line), a veil composed of aramid, glass, polyester, and PVAC (square line), and a veil composed of melamine, glass, polyester, and PVAC (triangle line) were tested according to the procedure set forth above. A temperature of approximately 800° F. is the temperature at which the flame is considered to have burned through the sample. The graph set forth in FIG. 8 shows that only the melamine, glass, polyester blend veil reached a temperature sufficient to burn through the veil. The veil composed of aramid, glass, and polyester fibers and the veil composed of aramid, glass, polyester, and PVAC passed the burn-through test.

Example 2

Veils formed of an aramid/PVC fiber blend (square line and "X" line), a melamine/PVC fiber blend (triangle line), a glass/PVC fiber blend (diamond line) were tested for burn through according to the procedure set forth above. As shown in FIG.

9, the veil formed of the melamine/PVC fibers burned through in approximately 20 seconds and was considered to have failed the test. The aramid/PVC fiber blend and glass/PVC fiber blend mats did not burn through and were therefore considered to be successful.

Example 3

An insulation product having a low density of approximately 1.02 lbs/ft$^3$ formed entirely of glass fibers was placed between two polyester mats (diamond line) and an insulation product having a higher density of approximately 1.75 lbs/ft$^3$ formed entirely of glass fibers was placed between two polyester mats (square line). These insulation/polyester mat sample products were then tested according to the test protocol set forth above. The polyester mats were placed on both sides of the insulation product to encapsulate the glass insulation and help prevent irritation to individuals handling the sample products. They were not intended to, and did not yield, any fire retarding properties.

Figure 10:
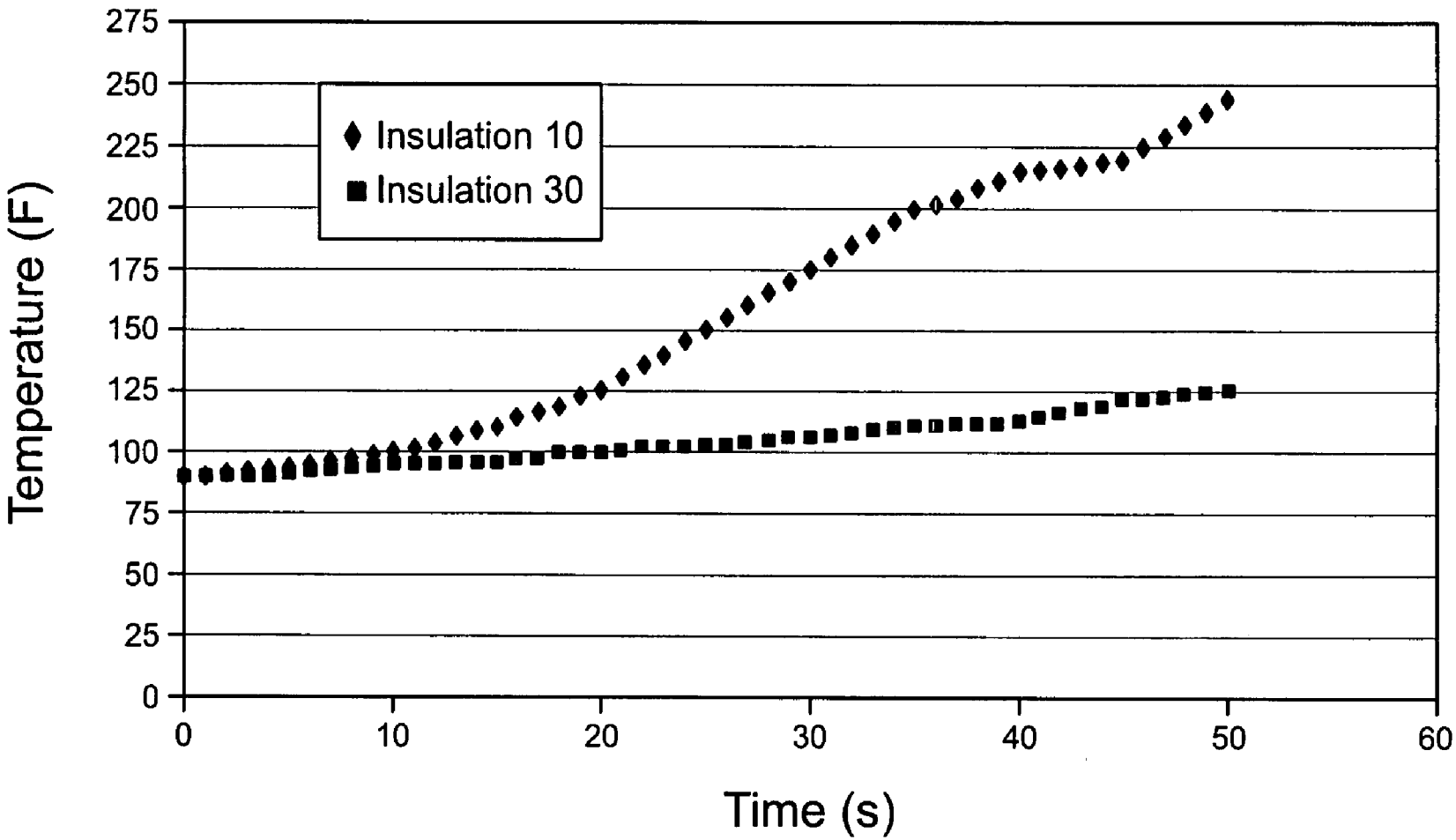
FIG. 10 is a graphical illustration of temperature versus time of an insulation product having a low density and an insulation product having a high density formed according to the principles of the present invention.

FIG. 10 is a graphical depiction of the temperature of the backside of the veil/insulation test samples. As depicted in FIG. 10, the maximum temperature of the backside of the low density insulation sample product was determined to be approximately 244° F. and the maximum temperature of the high density insulation sample product was determined to be approximately 124° F. As discussed previously, a temperature of approximately 800° F. is the temperature at which the flame is considered to have burned through the sample. Temperatures of 124° F. and 244° F. are significantly below the burn-through temperature. In addition, these values are well below the auto-combustion values for the foam cushioning of mattress. It was concluded that the insulation product according to the present invention provided unexpectedly superior results.

Example 4

The test was conducted in accordance with the flammability test protocol outlined in the State of California Department of Consumer Affairs Bureau of Home Furnishings and Thermal Insulation Bulletin 603, "Requirements and Test Procedure for Resistance of a Mattress/Box Spring Set to a Large Open-Flame," dated January, 2004, which is hereby incorporated by reference in its entirety. A composite including a backing layer, a veil composed of glass and binder, and an encapsulating layer was formed according to the instant invention and positioned on the bottom of a mattress. T-shaped burner heads were positioned approximately 300 mm (1 foot) from the side and top of the mattress. The flow rate of the propane gas through the top burner was approximately 12.9 L/min and the flow rate of propane through the side burner was approximately 6.6 L/min. The ambient temperature was above 12° C. (54° F.) and the relative humidity was below 70%. The side and top burners were ignited for 50 seconds and 70 seconds respectively and were then turned off. The mattress was permitted to burn freely for 30 minutes. At that time the burners were turned off. The rate of heat release was measured according to ASTM 1590. The results obtained are depicted in Table 1 and in FIG. 11.

TABLE 1

| Peak Heat Release Rate, During the 1st 30 Minutes (kW) | Time of Peak HRR (Min) | Total Heat Released At 10 min. (MJ) |
|---|---|---|
| 44 | 1.2 | 2.7 |

Figure 11:
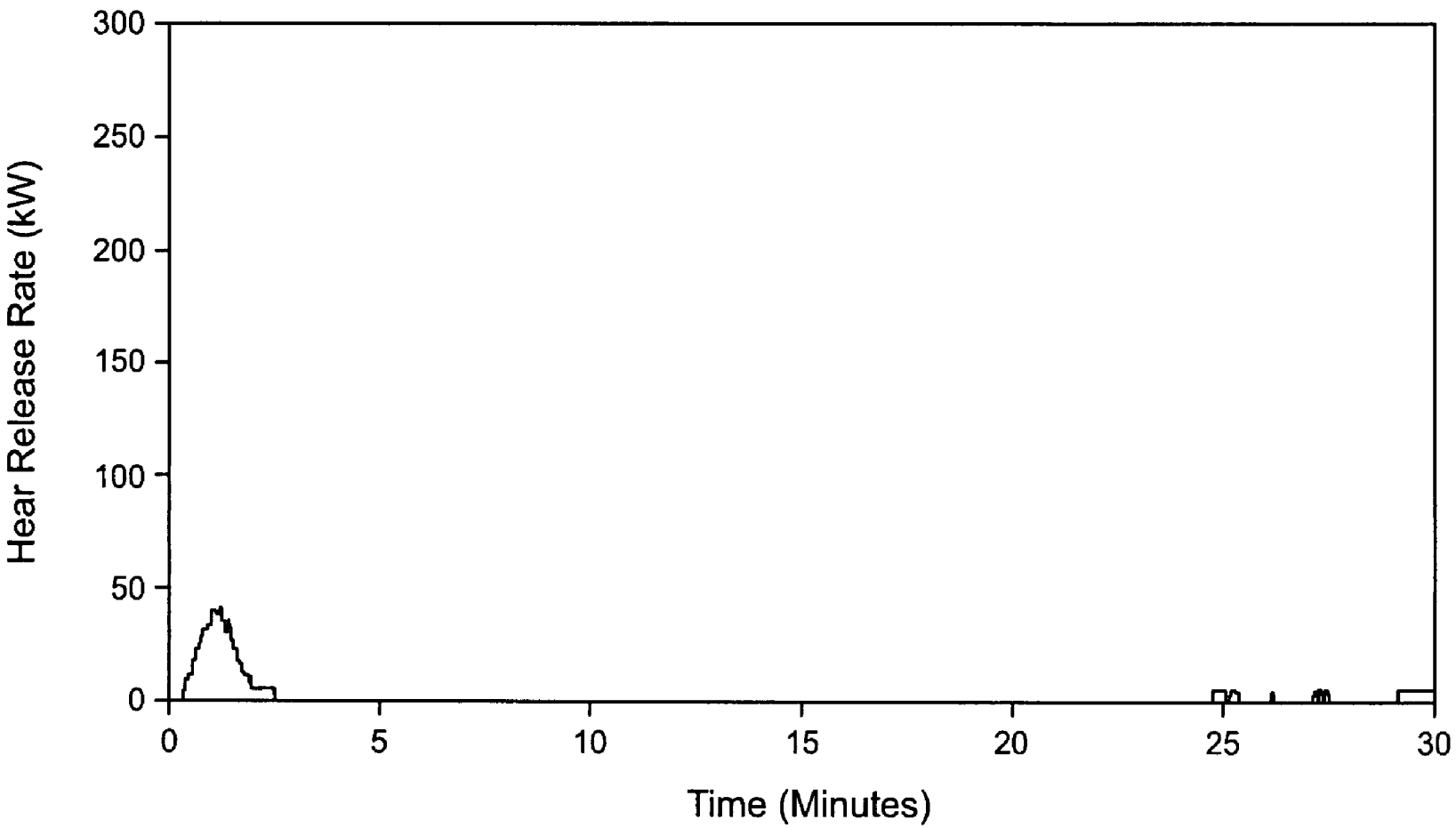
FIG. 11 is a graphical illustration of heat release rate versus time of a veil formed of glass fibers and binder according to at least one exemplary embodiment of the invention.

According to California Technical Bulletin 603 (TB 603), a mattress fails to meet the requirements of the test if (1) a peak rate of heat release of 200 kW or greater is obtained during the first 30 minutes of the test or if (2) a total heat release of 25 MJ or greater in the first 10 minutes of the test is obtained. As shown in Table 1 and in FIG. 11, a heat release of more than 200 kW was not obtained. In fact, as illustrated in FIG. 11, the peak heat release occurred in the first few minutes of testing and was approximately 50 kW. In addition, the total heat released, as shown in Table 1, was 2.7 MJ. Thus, it was determined that the veil formed of glass fibers and binder was a material that was compliant with the mattress flammability guidelines set by TB 603.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

Having thus described the invention, what is claimed is:

1. A fibrous article for use as a fire retardant comprising:

a wet-laid nonwoven fibrous veil including:

a plurality of randomly oriented glass fibers; and a binder composition, said binder composition including a binder and at least one fire retardant, wherein said fibrous article is a flame retarding composite comprising:

an encapsulating layer;

a backing layer formed of a fibrous material; and said wet-laid nonwoven fibrous veil, said fibrous veil being positioned between said backing layer and said encapsulating layer.

2. The fibrous article according to claim 1, wherein said encapsulating layer is selected from a thermoplastic polymer film, a thermoplastic polymer laminate, a spunbond fabric, a needlepunched fabric and a stitchbond fabric.

3. The fibrous article according to claim 2, wherein said encapsulating layer is affixed to said fibrous veil via an adhesive.

4. The fibrous article according to claim 1, wherein said fibrous veil consists of 100% by weight of said randomly oriented glass fibers and said binder composition.

5. The fibrous article according to claim 1, wherein said fibrous veil further includes a plurality of randomly oriented synthetic fibers.

* * * * *